US005750814A

United States Patent [19]

Grootjans et al.

[11] Patent Number: 5,750,814

[45] Date of Patent: May 12, 1998

[54] PROCESS FOR THE ALKYLATION OF AROMATICS

[75] Inventors: Jacques F. Grootjans, Leefdaal; Pierre-Frederic J. Belloir, Braine-Le-Comte; Eric J.G.M. Romers, Kraainem, all of Belgium

[73] Assignee: Fina Research, S.A., Feluy, Belgium

[21] Appl. No.: 472,018

[22] Filed: Jun. 6, 1995

Related U.S. Application Data

[63] Continuation of Ser. No. 65,090, May 20, 1993, abandoned.

[30] Foreign Application Priority Data

May 20, 1992 [EP] European Pat. Off. ..... 92870074

[51] Int. Cl.[6] ..... C07C 2/66

[52] U.S. Cl. ..... 585/323; 585/319; 585/448; 585/467

[58] Field of Search ..... 585/316, 319, 585/323, 446, 448, 467, 258, 259, 260

[56] References Cited

U.S. PATENT DOCUMENTS

| | | | |
|---|---|---|---|
| 4,459,426 | 7/1984 | Inwood et al. | 585/323 |
| 4,891,458 | 1/1990 | Innes et al. | 585/323 |

FOREIGN PATENT DOCUMENTS

| | | |
|---|---|---|
| 679584 | 4/1966 | Belgium . |
| 439632 | 5/1989 | European Pat. Off. . |
| 467007 | 1/1992 | European Pat. Off. . |
| 2295934 | 7/1976 | France . |
| 2053959 | 2/1981 | United Kingdom . |

*Primary Examiner*—Ponnathapura Achutamurthy
*Attorney, Agent, or Firm*—Pamela S. Smith; M. Norwood Cheairs

[57] ABSTRACT

A improved process is provided for the alkylation of aromatic compounds under at least partial liquid phase conditions, and in the presence of a zeolite-type alkylation/transalkylation catalyst. In accordance with the present process, a diluted aromatic hydrocarbon feedstock containing $C_5$–$C_7$ olefins is brought into contact with a diluted olefinic feedstream in the presence of the alkylation/transalkylation catalyst. Prior to contact with the olefinic feedstream, $C_5$–$C_7$ olefins present in the aromatic hydrocarbon feedstock are selectively hydrogenated.

13 Claims, No Drawings

PROCESS FOR THE ALKYLATION OF AROMATICS

This application is a continuation of Ser. No. 08/065,090 filed May 20, 1993, now abandoned.

TECHNICAL FIELD OF THE INVENTION

The present invention relates to a process for preparing alkylated aromatic compounds by subjecting a diluted aromatic hydrocarbon feedstock to alkylation by a diluted olefinic stream, or to transalkylation with a diluted polyalkyl aromatic hydrocarbon, under at least partial liquid phase conditions, in the presence of a zeolite-type material as the alkylation/transalkylation catalyst.

BACKGROUND OF THE INVENTION

The production of high octane gasoline, while placing out tetraethyl lead light olefins, and benzene, has long been an important goal of refineries. In addition to the production of such valuable fractions, most refineries produce an offgas stream containing diluted $C_2$ to $C_4$ olefins. Separation of these olefins is quite difficult and often uneconomical because the offgas stream is often heavily contaminated and contains only diluted olefins. Consequently, after a rough purification in a scrubber, these offgases are typically used as fuel gas.

U.S. Pat. No. 4,107,224 to Dwyer discloses a vapor phase process whereby benzene and diluted ethylene are reacted over a solid, porous catalyst such as ZSM-5. Dwyer states that a convenient source of such dilute ethylene is the tail gas from a refinery FCC unit. It is noted, however, that the dilute ethylene stream should be scrubbed with aqueous caustic to remove hydrogen sulfide and water, as these components are moderately detrimental to the Dwyer process. Dwyer also prefers that carbon dioxide be removed from the diluted ethylene stream utilized therein.

U.S. Pat. No. 4,891,458 to Innes discloses a process for the alkylation of aromatic hydrocarbon solefin over a zeolite beta catalyst having a low sodium content and specific area of at least 600 $m^2/g$. As indicated in column 4, lines 47–52, the aromatic hydrocarbon present in the feedstock consists essentially of aromatic compounds such as benzene, toluene and xylene; more preferably, the aromatic hydrocarbon feedstock is benzene. Additionally, the olefin feedstocks consist essentially of $C_2$ to $C_4$ olefins such as ethylene, propylene, butene-1, trans-butene-2 and cis-butene-2, with ethylene and propylene being most preferred.

As such, it would be advantageous if a process existed for alkylating the benzene present in light reformate or in pyrolysis gasoline with an olefinic stream containing, for example, ethylene, or ethylene and propylene. The alkylaromatics thus produced could then be used to either boost the octane rating of the gasoline, or could be separated by distillation to obtain valuable petrochemicals, particularly ethylbenzene.

SUMMARY OF THE INVENTION

According to the present invention, the Applicant has found an improved process for alkylating a diluted aromatic feedstock containing $C_5$–$C_7$ olefins in the presence of a diluted olefinic stream under at least partial liquid phase conditions to produce monoalkylated aromatic compounds. More specifically, the diluted aromatic hydrocarbon feedstock containing $C_5$–$C_7$ olefins is first subjected to selective hydrogenation in order to remove the $C_5$–$C_7$ olefins present in this feed. The present invention also provides a process for the alkylation of benzene present in light reformate, or in pyrolysis gasoline, with an olefinic stream, again under relatively mild, at least partial liquid phase conditions. The alkylaromatics obtained in this manner can then be used as an octane booster, or can be separated by distillation to obtain valuable petrochemicals, such as, for example, ethylbenzene. Because the alkylation reaction with diluted feed streams under at least partial liquid phase conditions is highly selective, ethylbenzene produced in accordance with the present invention is of high purity, containing only small amounts of xylene.

The hydrogenation catalyst used in the selective hydrogenation process of the present invention comprises any suitable hydrogenation catalyst like nickel, nickel-molybdenum, cobalt-molybdenum or palladium catalyst which can be supported or not. Examples of suitable supports include alumina, silica or alumina-silica. Alumina is the more preferred support.

After the hydrogenation treatment, the diluted aromatic hydrocarbon feedstock, which is now substantially free of $C_5$–$C_7$ olefins, is subjected to alkylation by a diluted olefinic stream in the presence of an alkylation/transalkylation catalyst. Catalysts suitable for use in the process of the present invention comprise zeolite-type materials selected from the group consisting of ZSM-12, Mazzite-type zeolite including ZSM-4 and zeolite omega, zeolite Y, faujasite and other large pore zeolites such as ZSM-20, mordenite, and zeolite beta, as well as modifications thereof. A particularly preferred catalyst is a modified beta zeolite characterized in terms of high surface area and low sodium content.

The diluted aromatic feedstocks useful for practicing the present invention contain less than 70 mole %, and preferably less than 50 mole %, of aromatic compounds. These aromatic feedstocks consist primarily of benzene, toluene, xylene, ethylbenzene and isopropylbenzene. Preferably, a catalytic reformate or a mixture of catalytic reformate and pyrolysis gasoline is employed as the aromatic feedstock, with catalytic reformate being more preferred.

The diluted olefinic streams useful for practicing the present invention contain $C_2$ to $C_4$ alkenes (mono-olefins), including at least 2 mole % ethylene, and a total $C_2$–$C_3$ alkenes content of between 10 to 40 mole %. Hydrogen and non-deleterious components, such as methane, $C_2$ to $C_4$ paraffins and inert gases, may also be present. In a preferred embodiment of the present invention, the diluted olefinic stream is a light gas by-product of FCC gas oil cracking units containing typically 1 to 40 mole % $C_2$–$C_3$ olefins, and 5 to 35 mole % hydrogen, with varying amounts of $C_1$ to $C_3$ paraffins and inert gases, such as nitrogen, carbon monoxide and carbon dioxide.

DETAILED DESCRIPTION OF THE INVENTION

In accordance with the present invention, there is provided a new and advantageous process for the alkylation and/or transalkylation of aromatic compounds under at least partial liquid phase conditions. The process comprises:

(a) subjecting a diluted aromatic hydrocarbon feedstock containing $C_5$–$C_7$ olefins to a selective hydrogenation of the $C_5$–$C_7$ olefins;

(b) supplying the feedstock resulting from step (a) to a reaction zone containing a zeolite-type aromatic alkylation catalyst;

(c) supplying a diluted olefinic alkylation agent containing stream to said reaction zone;

(d) operating said reaction zone at an average temperature and pressure sufficient to maintain said aromatic compound feedstock and said olefinic alkylation agent in at least partial liquid phase, said temperature and pressure conditions being effective to cause alkylation of said aromatic compounds by said alkylation agent in the presence of said catalyst; and (e) recovering alkylated aromatic compounds from said reaction zone.

A preferred application of the present invention is the production of alkylaromatic compounds from the diluted olefin rich gas feedstocks and the catalytic reformates described hereafter.

In one embodiment of the present invention, the reformate or mixture of reformate/pyrolysis gasoline stream contains at least 1 mole % of $C_5$–$C_7$ olefins. Applicants have found that the presence of $C_5$–$C_7$ olefins in the feedstock can lead to the rapid deactivation of the alkylation catalyst as indicated further in the examples. Therefore, the catalytic reformate is supplied to a reaction zone and brought into contact with a hydrogenation catalyst in order to selectively hydrogenate the $C_5$–$C_7$ olefins. The feedstocks containing the aromatic compounds and alkylating agents are then supplied to a reaction zone and brought into contact with a zeolite-type alkylation catalyst under at least partial liquid phase conditions.

When the process of the present invention is applied to the production of ethylbenzene, the formation of xylene is minimized and generally does not exceed 0.1 wt %, based on ethylbenzene formation, and more generally does not exceed 0.05 wt %.

Suitable hydrogenation catalysts useful in practicing the present invention include a nickel, nickel-molybdenum, cobalt-molybdenum or palladium catalyst which can be deposited on a support. When used, the support is preferably selected from alumina, silica or alumina-silica. Alumina is the most preferred support.

Catalytic reformates which can be used as the aromatic feedstock in the present invention generally have a specific gravity of between 0.70 to 0.90, a boiling range between 150° C. to 205° C., a benzene content of between 1.0 to 60 mole %, a toluene content of between 2.0 to 60 mole % and a $C_8$ aromatic content of between 4.0 and 60 mole %. Other components present in the catalytic reformate typically include paraffinic hydrocarbons and other aromatic hydrocarbons.

Pyrolysis gasoline suitable for use as the aromatic feedstream in the present process generally contains between 70 to 90 mole % benzene, 0 to 5 mole % toluene, 2 to 10 mole % olefins and 0 to 5 mole % $C_5$–$C_7$ paraffins.

In one embodiment of the present invention, the $C_5$–$C_7$ olefins present in the catalytic reformate are first hydrogenated in the presence of a hydrogenation catalyst. Preferred catalysts include palladium catalysts deposited on alumina. Preferred hydrogenation reaction conditions are as follow: Hydrogen/$C_5$–$C_7$ olefins molar ratio between 1 and 4; Reaction temperature from 50° C. to 150° C., and preferably from 80° C. to 120° C.; Reaction pressure of about 1 MPa; Contact time from 10 s to 10 h, preferably from 1 min to 1 h; and Weight Hourly Space Velocity (WHSV), in terms of grams of reformate per gram of catalyst per hour, from 1 to 50.

In another embodiment of the present invention, the $C_5$–$C_7$ olefins present in the pyrolysis gasoline are hydrogenated in the presence of a hydrogenation catalyst. Preferred catalysts include cobalt-molybdenum catalysts. Preferred hydrogenation reaction conditions are as follows: Hydrogen/$C_5$–$C_7$ olefins molar ratio between 5 and 25; Reaction temperature from 150° C. to 250° C., and preferably from 200° C. to 220° C.; Reaction pressure of about 4 MPa; Contact time from 10 s to 10 h, preferably from 1 min to 1 h; and Weight Hourly Space Velocity (WHSV), in terms of grams of reformate per gram of catalyst per hour, from 1 to 50.

In accordance with the present invention, various types of reactors can be utilized for the hydrogenation step. For example, the hydrogenation can be carried out in a fixed bed reactor in an upflow or downflow mode.

In one embodiment of the present invention, benzene is removed from the hydrogenated reformate or mixture reformate/pyrolysis gasoline stream by alkylation with an olefin rich gas feedstock, resulting in the production of alkylbenzene with a better octane number. The alkylation reaction is carried out in the presence of a zeolite-type alkylation catalyst under at least partial liquid phase condition thereby avoiding cracking reactions of other branched paraffinic compounds present in the reformate/pyrolysis fraction. The alkylaromatics obtained in this manner can then be used as an octane booster, or can be separated by distillation to obtain valuable petrochemicals, such as ethylbenzene. Because the alkylation reaction with the diluted feed in the at least partial liquid phase is highly selective, ethylbenzene produced in this manner is of high purity, containing very low amounts of xylene.

A suitable diluted olefinic stream for use in the present invention contains $C_2$ to $C_4$ alkenes (mono-olefins) including at least 2 mole % ethylene, and has a total $C_2$–$C_3$ alkenes content in the range of 10 to 40 mole %. Non-deleterious components, such as methane, $C_2$ to $C_4$ paraffins and inert gases, may also be present in the diluted olefinic feedstream. In a preferred embodiment of the present invention, the diluted olefinic feedstream is a light gas by-product of an FCC gas oil cracking unit, typically containing 10 to 40 mole % $C_2$–$C_3$ olefins, and 5 to 35 mole % hydrogen. Varying amounts of $C_1$ to $C_3$ paraffins, inert gasses such as nitrogen, carbon monoxide and carbon dioxide may also be present.

Suitable alkylation/transalkylation catalyst useful in practicing the present invention are selected from the group consisting of ZSM-12, Mazzite-type zeolites including ZSM-4 and zeolite omega, zeolite Y, faujasite and other large pore zeolites such as ZSM-20, mordenite, and zeolite beta, as well as modifications thereof. It is preferred that a modified zeolite beta, characterized in terms of high surface area and low sodium content be used as the alkylation catalyst in the present invention.

The Y zeolites for use in the process of the present invention are Y-type zeolites (or parent faujasite polytype such as ZSM-20) such as those described in U.S. Pat. No. 3,929,672, the disclosure of which is hereby incorporated by reference in its entirety.

Mazzite-type zeolite includes ZSM-4 and Omega zeolite; omega zeolites are fully described in U.S. Pat. No. 4,241,036 while ZSM-4 is described in British Patent No. 1,117,568, both of them are incorporated herein by references. ZSM-12 type zeolites are illustrated in U.S. Pat. No. 3,832,449 the disclosure of which is incorporated herein by reference. Mordenite-type zeolites suitable for the process must be of the large pore variety, as described for instance in U.S. Pat. No. 3,439,174.

Crystalline zeolite beta for use in the process of the present invention is identified by its X-ray diffraction patterns and basic procedures for its preparation are disclosed in U.S. Pat. No. 3,308,069 to Wadlinger et al. Zeolite beta is synthesized by the hydrothermal digestion of a reaction mixture comprising silica, alumina, and alkali or alkaline earth metal oxide or hydroxide and an organic templating agent. As disclosed in Wadlinger, the templating agent may be a tetraethylammonium hydroxide and suitable sources of sodium monoxide (or hydroxide) alumina and silica can be heated at a temperature of about 75° to 200° C. until crystallization of the zeolite beta occurs. The crystallized product can be removed from the reaction mixture, dried and then calcined in order to remove the templating agent from the interstitial channels of the molecular sieve network. Procedures other than those disclosed in Wadlinger can be used for the synthesis of zeolite beta. For example, European Patent Application 159,846 to Reuben discloses the synthesis of zeolite beta having a silica/alumina mole ratio of up to 300 employing a templating agent formed by the combination of dimethylbenzylamine and benzylhalide.

European Patent Application 165,208 to Bruce et al. discloses a similar procedure for the preparation of zeolite beta using dibenzyldimethylammonium halide or hydroxide with the silica and alumina components employed to provide a silica/alumina mole ratio in the produced zeolite beta between 20–250.

U.S. Pat. No. 4,642,226 to Calvert et al. discloses zeolite beta prepared by a process similar to those found in the above European patent applications employing dibenzyldimethylammonium hydroxide or chloride as the templating agent. As disclosed in European patent application 186,447 by Kennedy et al. zeolite beta may be prepared from reaction mixtures other than the conventional reaction mixtures employing silica and alumina as described previously and may be synthesized with trivalent framework ions other than aluminum to form, for example borosilicates, boroalumino silicates gallosilicates or galloaluminosilicates structural isotypes which are considered to constitute forms of zeolite beta.

The zeolite beta catalysts employed in the present invention preferably are of ultra-low sodium content. Low sodium content zeolite beta are in themselves known in the art.

The preferred zeolite beta employed in the present invention is also characterized in terms of a very high surface area specifically at least 600 $m^2/g$ based upon the crystalline zeolite beta. The preferred zeolite beta has a low sodium content of less than 0.04 wt % and preferably less than 0.02 wt %, expressed as $Na_2O$. The preferred zeolite beta is produced by means of a series of ion exchange and calcination procedures carried out employing as synthesized zeolite beta as a starting material. The synthesized zeolite beta can be produced by the hydrothermal digestion of a reaction mixture comprising silica, alumina, sodium or other alkyl metal oxide, and an organic templating agent in accordance with any suitable procedure such as those disclosed in the aforementioned U.S. Patents to Wadlinger et al. and Calvert et al. and the aforementioned European patent applications.

Typical digestion conditions include temperatures ranging from slightly below the boiling point of water at atmospheric pressure to about 170° at pressures equal to or greater than the vapor pressure of water at the temperature involved. The reaction mixture is subjected to mild agitation for periods ranging from about one day to several months to achieve the desired degree of crystallization to form the zeolite beta. Lower temperatures will normally require longer periods in order to arrive at the desired crystal formation. For example, at temperatures of about 100° C. crystal growth may occur during periods ranging from about one month to four months, whereas at temperature near the upper end of the aforementioned range, e.g., about 160° C., the digestion period may be one or two days up to about one week. At intermediate temperatures of about 120°–140° C., the digestion period may extend for about two to four weeks.

Any suitable templating agent may be used in forming the zeolite beta molecular sieve crystalline structure and, as indicated by the references referred to above, appropriate templating agents include tetraethylammonium hydroxide and halides such as tetraethylammonium chloride and dibenzyldimethylammonium chloride. The reaction components may be varied in accordance with techniques well known in the art to provide the zeolite beta product of varying silica/alumina ratios. Typically, the reaction mixture used to synthesize the zeolite beta molecular sieve will contain formulations within the following mole ratio ranges:

TABLE A

| | |
|---|---|
| $SiO_2/Al_2O_3$ | 20–1000 |
| $H_2O/SiO_2$ | 5–200 |
| $OH^-/SiO_2$ | 0.1–0.2 |
| $M/SiO_2$ | 0.01–1.0 |
| $R/SiO_2$ | 0.1–2.0 |

In Table A, R is the nitroorgano templating agent, e.g., a tetraethylammonium group and M is an alkali metal ion, usually, but not necessarily, sodium. For a further description of zeolite beta and methods for its synthesis, recourse may be made to the above patents and patent applications including, specifically, U.S. Pat. Nos. 3,308,069 (Wadlinger et al.) and 4,642,226 (Calvert et al.) and European Patent Application No. 90870211.1, the entire disclosures of which are incorporated herein by reference.

The as synthesized zeolite beta is initially subjected to an ion exchange step employing an ion exchange medium such as an aqueous solution of an inorganic ammonium salt, e.g., normal ammonium nitrate.

Following the ion exchange treatment, the zeolite beta is subjected to calcination at a temperature of about 4000 or more for a period of two or more hours. After the calcination treatment the zeolite beta is cooled and subjected to another ion exchange treatment which may be carried out with the same inorganic ammonium salt as described previously. At the conclusion of the second ion exchange treatment the zeolite beta normally will have a surface area at least twice that of the surface area of the original starting material and a very low sodium content. The sodium content, calculated as $Na_2O$, normally will be less than 0.04 wt % and usually less than 0.02 wt %.

Following the second ion exchange treatment, the zeolite beta is mixed with a binder such as alumina sol, gamma-alumina or other refractory oxides to produce a mulled zeolite beta-binder mixture. The mixture is then pelletized by any suitable technique such as extrusion and the resulting pellets then dried. At this point, the pelletized binder-zeolite product is calcined under conditions sufficient to decompose the ammonium ions on the active site so the zeolite beta is obtained in the acid ($H^+$) form.

It has also been found that interesting results in alkylation are obtained when zeolite beta is activated at 450° to 650° C. with a dry nitrogen stream during a period of time ranging from 1 to 4 hours or more.

In accordance with the improved process for the alkylation of a diluted aromatic hydrocarbon feedstock of the present invention, various types of reactors can be utilized. For example, the process can be carried out batchwise by adding the catalyst and the hydrogenated aromatic feedtock to a stirred autoclave, heating to reaction temperature, and then slowly adding the olefinic or polyalkylaromatic feedstock. A heat transfer fluid can be circulated through the jacket of the autoclave, or a condenser can be provided to remove the heat of reaction and maintain a constant temperature. Large scale industrial processes may employ a fixed bed reactor operating in an upflow or downflow mode, or a moving bed reactor operating with co-current or counter-current catalyst and hydrocarbon.

These reactors may contain a single catalyst bed or multiple beds, and may be equipped for the interstage addition of olefins and interstage cooling. Interstage olefin addition and more nearly isothermal operation enhance product quality and catalyst life. A moving bed reactor makes possible the continuous removal of spent catalyst for regeneration and replacement by fresh or regenerated catalysts.

In a fixed or moving bed reactor, alkylation is completed in a relatively short reaction zone following the introduction of olefin. Approximately 10 to 30% of the reacting aromatic molecules may be alkylated more than once depending on the aromatic:olefin ratio. Transalkylation proceeds more slowly than alkylation and occurs both in the alkylation zone and in the remainder of the catalyst bed. If transalkylation proceeds to equilibrium, better than 90 wt % selectivity to monoalkylated product can be achieved. Transalkylation, therefore, increases the yield of monoalkylated product by reacting the polyalkylated products with additional benzene.

The alkylation reactor effluent contains the excess aromatic feed, monoalkylated product, polyalkylated products, and various impurities. The aromatic feed is preferably recovered by distillation and recycled to the alkylation reactor. A small bleed can be taken from the recycle stream to eliminate unreactive impurities from the loop. The bottoms from the aromatic distillation are further distilled to separate monoalkylated product from polyalkylated products and other heavies.

Because only a small fraction of by-product xylene can be economically removed by distillation, it is important to have feedstocks containing very little xylene, and a catalyst which produces very small amounts of these impurities.

Multistage alkylation of aromatics may also be carried out in accordance with the present invention employing isothermal reaction zones. Isothermal reactors can be of the shell and tube type heat exchangers with the alkylation catalyst deposited within the tubes, and a heat transfer medium circulated through the shell surrounding the catalyst-filled tubes. The heat exchange medium is supplied through the reactors at rates to maintain a relatively constant temperature across each reaction state. In this case interstage cooling will be unnecessary but it is preferred that the olefin be injected at the front of each reaction stage.

In an embodiment of the present invention, monoalkylated aromatic compounds can be prepared in high yield by combining alkylation and transalkylation in a process which comprises on top of steps (a) to (d) defined hereabove the further steps of:

(e) separating the products from step (d) into fractions comprising (1) an aromatic hydrocarbon fraction, (2) a monoalkyl aromatic hydrocarbon fraction and (3) a polyalkyl aromatic hydrocarbon fraction; and (f) supplying the polyalkyl aromatic hydrocarbon fraction into the reaction zone defined in step (a) hereabove.

The present invention is especially applicable to the ethylation of benzene rich cuts under mild liquid phase conditions producing little or no xylene make, and the invention will be described specifically by reference to the production of ethylbenzene.

Preferred alkylation reaction conditions for practicing the present invention are as follows. The aromatic hydrocarbon feed should be present in a stoechiometric excess, and it is preferred that the molar ratio of aromatics to olefins be at least 3:1 to prevent catalyst fouling. The reaction temperature is generally in the range of from 38° C. to 300° C., and preferably 120° C. to 260° C. In the case of ethylbenzene production, a temperature range of 150° C. to 260° C. is most preferred.

The reaction pressure should be sufficient to maintain an at least partial liquid phase in order to retard catalyst fouling. This is typically 0.3 to 7 MPa depending on the feedstock and reaction temperature. Contact time may range from 10 seconds to 10 hours, but is usually from 5 minutes to an hour. The weight hourly space velocity (WHSV), in terms of grams of aromatic hydrocarbon and olefin per gram of catalyst per hour, is generally within the range of 0.5 to 50.

The following examples will serve to further illustrate and instruct one skilled in the art how to practice the present invention, and are not intended to be construed as limiting the invention as described in this specification, including the attached claims.

EXAMPLE 1

Preparation of H-beta Zeolite

From a commercial powder, the zeolite beta was ion-exchanged 3 times with a solution of ammonium nitrate at 85° C. during 2 hours. Afterwards, it was washed and dried at 110° C. during 8 hours. After calcining at 500° C. under $N_2$ and then cooling to 300° C. under $N_2$, the catalyst was calcined in air at 560° C. during 2 hours. Another series of 3 exchanges with ammonium, washing and drying at 110C converted the zeolite to its hydrogen form. It was then extruded with alumina binder and calcined to give the final catalyst having a surface area of 642M$^2$/g and less than 0.01 wt % of $Na_2O$.

Experimental Conditions

The diluted aromatic feedstock is a reformate, the composition of which is given in Table 1. This feedstock is selectively hydrogenated in the presence of 50 ml of a palladium on alumina catalyst ($Pd/Al_2O_3$-LD265 from protocatalyse) in order to remove the $C_5$–$C_7$ olefins under the following conditions:

| | |
|---|---|
| T (°C.) | 100 |
| P (MPa) | 1 |
| LHSV (hr$^{-1}$) | 10 |
| Hydrogen/$C_5$–$C_7$ olefins molar ratio | 2.3 |
| Mode | downflow |

The hydrogenated reformate is saturated with olefins rich gas to obtain the desired aromatics/olefins ratio (composition given in Table 1). 10 ml of the H-beta zeolite activated at 450° C. with pure nitrogen for approximately 3 hours is loaded in the reactor.

The starting alkylation/transalkylation conditions are:

| | |
|---|---|
| T (°C.) | 200 |
| P (MPa) | 6 |
| LHSV (hr$^{-1}$) | 10 |
| Mode | Upflow |

With a reactor temperature of 205° C., the selectivity to mono-, di- and tri-ethylbenzene versus converted benzene are respectively 80–82, 5–6 and 0.2–0.3. About 300 ppm of xylene are detected versus ethylbenzene produced.

As indicated in Table 2, ethylene conversion is complete. Furthermore, there is no significant deactivation after 19 days on stream.

TABLE I (Composition of the Feedstocks)

| | MEDIUM FORMATE | HYDROGENATED FORMATE SATURATED WITH FCC GAS |
|---|---|---|
| Molar Ratios | | |
| Benz/Olefins | 16.3 | 4.2 |
| Benz/C2= | — | 4.5 |
| Benz/C3= | — | 57 |
| Benz/C4= | 1471 | 760 |
| Benz/C5 | 167 | — |
| Benz/C6= | 18 | — |
| C2=/C3= | — | 12.7 |
| Compounds (wt %) | | |
| C1 | 0.00 | 0.09 |
| C2 | 0.00 | 0.12 |
| C2= | 0.00 | 1.56 |
| C3 | 0.00 | 0.04 |
| C3= | 0.00 | 0.18 |
| C4 | 0.46 | 0.44 |
| C4= | 0.01 | 0.02 |
| iC5 | 3.93 | 3.71 |
| nC5 | 3.45 | 3.31 |
| C5= | 0.11 | 0.00 |
| 2,2DMC4 | 2.00 | 1.93 |
| cycC5 | 0.47 | 0.47 |
| 2,3DMC4 | 2.86 | 3.01 |
| 2MC5 | 15.91 | 15.97 |
| 3MC5 | 16.63 | 15.97 |
| nC6 | 27.88 | 27.61 |
| McycC5 | 3.14 | 3.19 |
| C6= | 1.21 | 0.00 |
| 2,4DMC5 | 0.58 | 0.57 |
| 3.3DMC5 | 0.13 | 0.19 |
| Benz | 20.49 | 19.69 |
| cycC6 | 0.10 | 0.35 |
| 2MC6 | 0.15 | 0.35 |
| 3MC6 | 0.32 | 0.29 |
| nC7 | 0.05 | 0.05 |
| Toluene | 0.12 | 0.11 |

TABLE II (Benzene Alkylation with Hydrogenated Reformate)
RUN CONDITIONS

| | | | | | | | | | | | |
|---|---|---|---|---|---|---|---|---|---|---|---|
| TEMPERATURE (C) | 200.0 | 200.0 | 205.0 | 205.0 | 205.0 | 205.0 | 205.0 | 205.0 | 205.0 | 205.0 | 205.0 |
| PRESSURE (MPa) | 6.0 | 6.0 | 6.0 | 6.0 | 6.0 | 6.0 | 6.0 | 6.0 | 6.0 | 6.0 | 6.0 |
| LHSV (h-1) | 10.0 | 10.0 | 10.0 | 10.0 | 10.0 | 10.0 | 10.0 | 10.0 | 10.0 | 10.0 | 10.0 |
| TIME (hr) | 47.0 | 71.0 | 143.0 | 167.0 | 191.0 | 215.0 | 239.0 | 312.0 | 336.0 | 360.0 | 456.0 |
| CONVERSION (mol %) | | | | | | | | | | | |
| C2= | 98.9 | 99.1 | 98.7 | 98.4 | 98.9 | 98.8 | 98.9 | 98.6 | 98.9 | 98.9 | 99.5 |
| C3= | 100.0 | 100.0 | 100.0 | 100.0 | 100.0 | 100.0 | 100.0 | 100.0 | 100.0 | 100.0 | 100.0 |
| C4= | 100.0 | 100.0 | 100.0 | 100.0 | 100.0 | 100.0 | 100.0 | 100.0 | 100.0 | 100.0 | 100.0 |
| C5= | 100.0 | 100.0 | 100.0 | 100.0 | 100.0 | 100.0 | 100.0 | 100.0 | 100.0 | 100.0 | 100.0 |
| C6= | 100.0 | 100.0 | 100.0 | 100.0 | 100.0 | 100.0 | 100.0 | 100.0 | 100.0 | 100.0 | 100.0 |
| BENZENE | 18.3 | 15.1 | 14.8 | 14.7 | 14.6 | 14.5 | 14.4 | 14.2 | 13.8 | 12.8 | 12.0 |
| SELECTIVITIES (%) | | | | | | | | | | | |
| C2Benz | 80.4 | 81.6 | 81.2 | 81.0 | 81.1 | 80.2 | 81.1 | 81.0 | 80.8 | 81.0 | 80.9 |
| iC3Benz | 8.9 | 9.0 | 9.1 | 9.2 | 9.4 | 9.5 | 9.5 | 9.8 | 10.0 | 10.2 | 10.4 |
| sC4Benz | 0.9 | 0.9 | 0.9 | 0.9 | 1.0 | 1.0 | 0.9 | 0.9 | 1.0 | 1.0 | 1.0 |
| DiC2Benz | 6.1 | 5.7 | 5.6 | 5.6 | 5.5 | 5.5 | 5.3 | 5.3 | 5.1 | 4.9 | 4.8 |
| C2iC3Benz | 1.0 | 0.9 | 0.9 | 1.0 | 0.9 | 0.9 | 1.0 | 0.9 | 1.0 | 0.9 | 0.9 |
| DiiC3Benz | 0.5 | 0.5 | 0.5 | 0.5 | 0.5 | 0.6 | 0.5 | 0.4 | 0.4 | 0.5 | 0.5 |
| TriC2Benz | 0.3 | 0.2 | 0.2 | 0.2 | 0.2 | 0.3 | 0.2 | 0.2 | 0.2 | 0.2 | 0.2 |
| C5Benz | 0.1 | 0.0 | 0.2 | 0.1 | 0.1 | 0.1 | 0.1 | 0.1 | 0.1 | 0.1 | 0.1 |
| C6Benz | 1.2 | 1.0 | 1.1 | 1.3 | 1.2 | 1.5 | 1.2 | 1.3 | 1.1 | 1.1 | 1.1 |
| Others | 0.6 | 0.2 | 0.3 | 0.2 | 0.1 | 0.4 | 0.1 | 0.1 | 0.3 | 0.1 | 0.1 |

EXAMPLE 2 (Comparative)

The H-beta zeolite employed is identical to the one of Example 1. The composition of the feed is given in Table 3. The same procedure as in Example 1 is repeated except that no hydrogenation step is performed. The starting alkylation conditions are identical (200° C., 6 MPa, 10 $hr^{-1}$). The alkylation results are given in Table 4. As indicated therein ethylene conversion drops rapidly to 84% after 45 hours on stream. Even some attempts to increase or at least to maintain the ethylene conversion either by lowering the LHSV or by increasing the temperature were unsuccessful as indicated respectively in Tables 4 and 5.

TABLE 3

| (Composition of Feedstock) | |
|---|---|
| Compounds (wt %) | |
| C1 | 0.13 |
| C2 | 0.14 |
| C2= | 1.01 |
| C3 | 0.03 |
| C3= | 0.16 |
| C4 | 0.49 |
| C4= | 0.05 |
| iC5 | 3.98 |
| nC5 | 3.47 |
| C5= | 0.10 |
| 2,2DMC4 | 2.03 |
| cycC5 | 0.48 |
| 2,3DMC4 | 3.00 |
| 2MC5 | 15.99 |
| 3MC5 | 16.64 |
| nC6 | 27.08 |
| McycC5 | 2.89 |
| C6= | 1.05 |
| 2,4DMC5 | 0.46 |
| 3,3DMC5 | 0.10 |
| Benz | 19.96 |
| cycC6 | 0.09 |
| 2MC6 | 0.29 |
| 3MC6 | 0.24 |
| nC7 | 0.04 |
| Toluene | 0.10 |

TABLE IV

| RUN CONDITIONS | | | | | | |
|---|---|---|---|---|---|---|
| TEMPERATURE (C.) | 199.0 | 199.0 | 209.0 | 220.0 | 230.0 | 239.0 |
| PRESSURE (MPa) | 6.0 | 6.0 | 6.0 | 6.0 | 6.0 | 6.0 |
| LHSV (h-1) | 10.0 | 10.0 | 10.0 | 10.0 | 10.0 | 10.0 |
| TIME (hr) | 21.0 | 45.0 | 73.0 | 141.0 | 165.0 | 189.0 |
| CONVERSION (mol %) | | | | | | |
| C2= | 100.0 | 83.7 | 72.8 | 33.6 | 28.4 | 29.5 |
| C3= | 100.0 | 100.0 | 100.0 | 100.0 | 100.0 | 100.0 |
| C4= | 100.0 | 100.0 | 100.0 | 100.0 | 100.0 | 100.0 |
| C5= | 100.0 | 100.0 | 100.0 | 100.0 | 100.0 | 100.0 |
| C6= | 100.0 | 100.0 | 100.0 | 98.6 | 98.6 | 98.8 |
| SELECTIVITIES (%) | | | | | | |
| C2Benz | 48.4 | 46.0 | 39.8 | 19.6 | 19.4 | 22.7 |
| iC3Benz | 6.4 | 7.6 | 8.4 | 11.4 | 10.6 | 10.9 |
| tC4Benz | 0.1 | 1.0 | 1.7 | 4.4 | 3.5 | 3.1 |
| sC4Benz | 1.7 | 1.9 | 2.1 | 2.8 | 2.6 | 2.8 |
| DiC2Benz | 2.4 | 1.7 | 1.4 | 0.4 | 0.5 | 0.7 |
| C2iC3Benz | 1.7 | 1.6 | 1.8 | 2.0 | 2.3 | 2.2 |
| DiiC3Benz | 8.3 | 8.6 | 9.2 | 9.4 | 9.5 | 10.8 |
| TriC2Benz | 0.1 | 0.0 | 0.1 | 0.1 | 0.0 | 0.0 |
| C5Benz | 1.8 | 2.7 | 2.9 | 3.0 | 3.0 | 3.4 |
| C6Benz | 23.7 | 19.9 | 21.6 | 31.9 | 29.2 | 30.6 |
| Others | 5.4 | 9.0 | 11.0 | 15.0 | 19.4 | 12.8 |

TABLE V

| RUN CONDITIONS | | | | | | |
|---|---|---|---|---|---|---|
| TEMPERATURE (C.) | 200.0 | 199.0 | 199.0 | 200.0 | 200.0 | 210.0 |
| PRESSURE (MPa) | 6.0 | 6.0 | 6.0 | 6.0 | 6.0 | 6.0 |
| LHSV (h-1) | 10.0 | 10.0 | 8.0 | 4.5 | 2.7 | 2.5 |
| TIME (hr) | 21.0 | 45.0 | 74.0 | 142.0 | 166.0 | 190.0 |
| CONVERSION (mol %) | | | | | | |
| C2= | 100.0 | 85.4 | 52.1 | 30.3 | 23.8 | 64.5 |
| C3= | 100.0 | 100.0 | 100.0 | 100.0 | 100.0 | 100.0 |
| C4= | 100.0 | 100.0 | 100.0 | 100.0 | 100.0 | 100.0 |
| C5= | 100.0 | 100.0 | 100.0 | 100.0 | 100.0 | 100.0 |
| C6= | 100.0 | 100.0 | 100.0 | 100.0 | 100.0 | 100.0 |
| SELECTIVITIES (%) | | | | | | |
| C2Benz | 48.4 | 46.0 | 37.5 | 25.5 | 27.1 | 41.0 |
| iC3Benz | 6.5 | 7.2 | 9.2 | 10.2 | 9.9 | 7.8 |
| tC4Benz | 0.1 | 0.7 | 3.0 | 4.4 | 4.1 | 0.9 |
| sC4Benz | 1.7 | 1.8 | 2.3 | 2.5 | 2.5 | 2.1 |
| DiC2Benz | 2.3 | 1.8 | 1.2 | 0.7 | 0.8 | 1.6 |
| C2iC3Benz | 1.6 | 1.6 | 1.8 | 1.8 | 1.8 | 1.8 |
| DiiC3Benz | 8.3 | 9.3 | 8.3 | 7.6 | 7.7 | 9.6 |
| TriC2Benz | 0.1 | 0.1 | 0.0 | 0.1 | 0.1 | 0.1 |
| C5Benz | 1.9 | 2.8 | 2.7 | 2.6 | 2.6 | 2.8 |
| C6Benz | 23.8 | 19.8 | 21.2 | 29.7 | 28.5 | 22.8 |
| Others | 5.3 | 8.9 | 12.8 | 14.9 | 14.9 | 9.5 |

Having described a few specific embodiments of the present invention, it will be understood by those skilled in the art that modifications may be made without departing from the scope of the present invention.

We claim:

1. In a process for at least partial liquid phase alkylation and/or transalkylation of aromatic compounds, the steps comprising:

(a) Subjecting a hydrocarbon feedstock comprising aromatics and $C_5$–$C_7$ olefins to a selective hydrogenation of the $C_5$–$C_7$ olefins, said feedstock diluted with at least 30 mole percent non-aromatic hydrocarbons;

(b) supplying the feedstock resulting from step (a) to a reaction zone containing a zeolite-type aromatic alkylation/transalkylation catalyst;

(c) supplying an alkylation agent comprising olefins to said reaction zone, said alkylation agent diluted with non-aromatic hydrocarbons;

(d) operating said reaction zone at an average temperature and pressure sufficient to maintain said hydrocarbon feedstock comprising aromatics and said alkylation agent comprising olefins in at least partial liquid phase, said temperature and pressure conditions being effective to cause alkylation of said aromatic compounds by said alkylation agent in the presence of said catalyst; and (e) recovering alkylated aromatic compounds from said reaction zone.

2. The process according to claim 1 wherein the hydrocarbon feedstock comprising aromatics is a catalytic reformate or a mixture of catalytic reformate and pyrolysis gasoline.

3. The process according to claim 1 wherein the alkylation agent comprising olefins contains at least 2 mole % ethylene, and has a total $C_2$–$C_3$ alkenes content in the range of 10 to 40 mole %.

4. The process according to claim 1 wherein said alkylation/transalkylation catalyst is selected from the group consisting of nickel, nickel-molybdenum, cobalt-molybdenum and palladium catalyst, deposited on a support selected from the group consisting of alumina, silica and alumina-silica.

5. The process according to claim 1 wherein the alkylation/transalkylation catalyst is selected from the group consisting of ZSM-12, ZSM-4 zeolite omega, zeolite Y, faujasite ZSM-20, mordenite and zeolite beta.

6. The process according the claim 5 wherein the alkylation/transalkylation catalyst is a zeolite beta having a surface area of at least 600 $m^2/g$ and a sodium content of less than 0.04 wt % expressed as $Na_2O$.

7. The process according to claim 1 wherein the molar ratio of aromatics to olefins is at least about three to one (3:1).

8. The process according to claim 1 further comprising:

(f) separating the products from step into fractions comprising (1) an aromatic hydrocarbon fractions, (2) a monoalkyl aromatic hydrocarbon fraction and (3) a polyalkyl aromatic hydrocarbon fractions; and (g) supplying the polyalkyl aromatic hydrocarbon fraction into the reaction zone defined in step (a) hereabove.

9. In a process for at least the partial liquid phase alkylation and/or transalkylation of aromatic compounds, the steps comprising:

(a) subjecting a hydrocarbon feedstock comprising aromatics and $C_5$–$C_7$ olefins to a selective hydrogenation of the $C_5$–$C_7$ olefins, wherein said feedstock contains less than 69 mole percent of aromatic compounds; and (b) supplying said feedstock resulting from step (a) to a reaction zone containing a zeolite-type aromatic alkylation/transalkylation catalyst, said catalyst selected from the group consisting of nickel, nickel molybdenum, cobalt-molybdenum or palladium catalyst deposited on a support preferably selected from alumina, silica or alumina- silica;

(c) supplying an alkylation agent comprising olefins to said reaction zone, wherein said alkylation agent contains at least 2 mole percent ethylene and has a total $C_2$–$C_3$ alkenes content in the range of 10 to 40 mole percent;

(d) operating said reaction zone at an average temperature and pressure sufficient to maintain said hydrocarbon feedstock comprising aromatics and said alkylation agent comprising olefins in at least partial liquid phase, said temperature and pressure conditions being effective to cause alkylation of said aromatic compounds by said alkylation agent in the presence of said catalyst; and (e) recovering alkylated aromatic compounds from said reaction zone.

10. The process according to claim 3 wherein the alkylation agent further comprises a diluent selected from the group consisting of hydrogen, nitrogen, carbon monoxide and carbon dioxide.

11. The process according to claim 10 wherein the alkylation agent comprising olefins is a by-product of a FCC gas oil cracking unit.

12. In a process for at least partial liquid phase alkylation and/or transalkylation of aromatic compounds, the steps comprising:

(a) Subjecting a hydrocarbon feedstock comprising catalytic reformate containing $C_5$–$C_7$ olefins to a selective hydrogenation of the $C_5$–$C_7$ olefins, wherein the aromatic content of the feedstock is less than 70 mole percent;

(b) supplying the feedstock resulting from step (a) to a reaction zone containing a zeolite-type aromatic alkylation/transalkylation catalyst;

(c) supplying an alkylation agent comprising olefins to said reaction zone, wherein said alkylation agent is a by-product of an FCC gas oil cracking unit;

(d) operating said reaction zone at an average temperature and pressure sufficient to maintain said hydrocarbons feedstock comprising aromatic and said alkylation agent comprising olefins in at least partial liquid phase, said temperature and pressure conditions being effective to cause alkylation of said aromatic compounds by said alkylation agent in the presence of said catalyst; and (e) recovering alkylated aromatic compounds from said reaction zone.

13. The process according to claim 12 wherein the alkylated aromatic compounds recovered contain less than 0.1 weight percent xylene based on the weight of ethylbenzene.

* * * * *